US006533393B1

(12) United States Patent
Meyer et al.

(10) Patent No.: US 6,533,393 B1
(45) Date of Patent: Mar. 18, 2003

(54) PRINTER WITH MULTIPLE PRINTMODES PER SWATH

(75) Inventors: John F Meyer, San Diego, CA (US); Steven T. Castle, Philomath, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/629,547

(22) Filed: Jul. 31, 2000

(51) Int. Cl.[7] ..... B41J 2/21
(52) U.S. Cl. ..... 347/43; 347/15; 347/41
(58) Field of Search ..... 347/43, 40, 41, 347/12, 15, 14; 358/1.2, 1.9

(56) References Cited

U.S. PATENT DOCUMENTS 5,044,796 A 9/1991 Lund
5,488,398 A * 1/1996 Matsubara et al. ..... 347/43
5,598,192 A * 1/1997 Burger et al. ..... 347/43
5,731,823 A 3/1998 Miller et al.
5,754,198 A * 5/1998 Nishikawa ..... 347/43
5,778,160 A 7/1998 Smith
5,784,078 A * 7/1998 Furuya ..... 347/41
5,841,549 A 11/1998 Munakata
6,164,756 A * 12/2000 Takahashi et al. ..... 347/43
6,209,987 B1 * 4/2001 Katayama ..... 347/43
6,213,584 B1 * 4/2001 Noyes et al. ..... 347/40
6,302,520 B1 * 10/2001 Akiyama et al. ..... 347/43

* cited by examiner

*Primary Examiner*—Lamson Nguyen

(57) ABSTRACT

A swath printer and printing method using multiple printmodes per swath to improve printing time for print data that contains a mix of monochrome regions such as text, and color regions such as photographic images. Monochrome regions typically can be printed with a given print quality level using a fewer number of scans or passes over the area than can color regions. Throughput can be improved by identifying color and monochrome regions of each swath, and switching printmodes when printing these different areas of the swath. Because reversing direction at region boundaries in the middle of a swath can adversely affect printing throughput, the ratio of the size of monochrome regions to color regions is analyzed to ensure that throughput will be improved before enabling multiple printmode per swath mode. A number of different combinations of monochrome printmodes and color printmodes can be advantageously implemented.

23 Claims, 15 Drawing Sheets

PRINTER WITH MULTIPLE PRINTMODES PER SWATH

FIELD OF THE INVENTION

The present invention relates generally to printers which print a swath of data on a print medium at a time, and pertains more particularly to printmodes for improving the throughput of inkjet printers.

BACKGROUND OF THE INVENTION

Inkjet printers, and thermal inkjet printers in particular, have come into widespread use in businesses and homes because of their low cost, high print quality, and color printing capability. These devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988). The construction and operation of inkjet printers is relatively straightforward, with the basics of the technology further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No.1 (February 1994)], all of which are incorporated herein by reference. In particular, drops of one or more colored inks are emitted onto a print medium such as paper or transparency film during a printing operation, in response to commands electronically transmitted to one or more printheads in the printer. Inkjet printers may use a number of different ink colors. Each printhead typically emits ink of a different color onto the media. In one commonly used arrangement, the inks are the primary subtractive colors magenta, cyan, and yellow. Alternatively the printer can use more than three color inks, some of which may be lighter and darker versions of a given color shade. Many printers also include a black ink for printing text, and which may also be used during color printing to form the darker shades of colors. The different color inks combine on the print media to form the text and images which are perceived by the human eye. Drops of the color inks can be combined in the same pixels to form a range of perceived colors to the human eye. For example, superimposing drops of magenta and cyan inks in the same location produces a blue color.

One or more printheads for different color inks may be contained in a print cartridge, which may either contain the supply of ink for each printhead or be connected to an ink supply located off-cartridge. An inkjet printer frequently can accommodate two to four print cartridges. The cartridges typically are mounted side-by-side in a carriage which scans the cartridges back and forth within the printer in a forward and a rearward direction with respect to the medium during printing such that the cartridges move sequentially adjacent to given printing locations, called pixels, which are arranged in a row and column format on the medium. Each printhead typically has an arrangement of nozzles through which the ink drops are controllably ejected onto the print medium, and thus a certain width strip of the medium, corresponding to the layout of the nozzle arrangement, can be printed during each scan to form a printed swath. In order to form high quality text and images on the medium, multiple passes of the printhead arrangement back and forth are frequently required to fully print all the pixels of an individual swath. A print medium advance mechanism moves the media relative to the printhead arrangement in a direction generally perpendicular to the movement of the carriage so that, by combining the scans of the print cartridges back and forth across the medium, the emission of ink drops during each scan, and the advance of the medium relative to the printhead arrangement, ink can be deposited on the entire printable area of the medium. The particular combination of scans, ink drop emission during each scan, and the amount and timing of the medium advance used to print on the medium is generally referred to as a "printmode".

One factor that is very important to purchasers of inkjet printers is the speed at which a page of information can be printed, which in turn relates to the throughput, or the number of pages that can be printed in a given amount of time. Speed and throughput depend upon a number of factors. One of the most significant ones is the number of times that the printhead arrangement must scan an individual swath in order to print all the pixels in the swath—the more scans required, the longer the printing time. The number of scans required depends on the type of information contained in the swath. For example, high quality monochrome (typically black) textual output can typically be produced with a printmode having fewer passes than are required to produce correspondingly high quality color image or color photographic output.

Some printers allow printing a page of information using only a single printmode. Such printers examine the type of information to be printed on the page in order to determine the printmode to be used. If the page contains only textual information of a single color, a monochrome printmode with fewer passes can be used, but if the page contains any color image information a color printmode with more passes must be used and the page will take a longer time to print.

Some other printers have the ability to select the printmode to be used for each individual swath. These printers examine the type of information to be printed on the page on a swath-by-swath basis. For example, if only certain sections of the information contain color images, with the rest of the information being monochrome text, then swaths containing only textual information can be printed using a monochrome printmode with fewer passes, and a color printmode having more passes will be used only for those swaths which contain color image information. Such a single-printmode-per-swath printing scheme improves throughput relative to a printmode-per-page scheme. However, for many printed pages color images make up only a portion of each swath, with monochrome text making up the remainder of the swath. In such situations, the printer throughput is significantly lower than could be achieved if only the image portion of the swath is printed with the greater number of passes of the color printmode, while the text portion of the swath is printed with the fewer number of passes of the monochrome printmode. In addition to reduced throughput, printing the text portions of swaths containing no color images with the monochrome printmode, while printing the text portions of adjacent swaths which do contain color images with the color printmode, can cause visible variations between the adjacent text portions that some users find to be of objectionable print quality. Accordingly, it would be highly desirable to have a new and improved printer and method for printing swaths that prints mixed monochrome and color pages faster and with higher quality.

SUMMARY OF THE INVENTION

In a preferred embodiment, the present invention provides a novel method for printing color and monochrome regions of a single swath of halftoned data with different printmodes so as to increase the printing speed of high-quality printed output. According to the novel printing method, the data swath is processed to identify the color and monochrome regions, which typically alternate in the swath. A printhead arrangement is moved relative to a medium in a forward or a backward scan direction over color printing areas of the medium a greater number of times while printing color regions, and a fewer number of times over monochrome printing areas while printing monochrome regions (the number of times is also referred to as a "scan" or a "pass"). This advantageously reduces the printing time compared to the time would be required if the printhead arrangement was moved over all printing areas the greater number of times. In addition to movement in the scan direction, the printhead arrangement is also periodically advanced relative to the medium in a medium advance direction which is substantially orthogonal to the scan direction. Preferentially the advancing occurs after printing the entire swath of data, but in alternative embodiments the advancing occurs at certain times when the printhead arrangement is reversing direction between the forward and backward scan directions. The preferred method also verifies that a ratio of a size of the monochrome regions to the color regions exceeds a threshold value, in order to assure that any increase in printing time resulting from the more frequent changes in the scan direction are more than offset by the decrease in printing time that results from the use of the lesser number of passes used to print the monochrome regions. If the ratio does not exceed the threshold value, then instead of printing the color and monochrome regions differently, the method treats the swath as if it consists of a single color region, printing it using the greater number of passes. The method has a relationship between the specific numbers of passes used to print the monochrome and color areas. If M passes are used to print monochrome regions of a swath having at least one color region located at a middle portion of the swath between two monochrome regions, then M+2N passes can be used to print the color regions, where N is an integer greater than zero. If M passes are used to print a monochrome region of a swath having only a single color region located at an end portion of the swath, then M+N passes can be used to print the color region if M is odd, and M+2N passes can be used to print the color region if M is even, where N is an integer greater than zero. Approximately 1/Mth of each of each monochrome region is printed during each of the M passes over that region, and approximately 1/Cth of each of each color region is printed during each of the C passes over that region. The method also verifies that the number and locations in the swath of the monochrome and color region or regions are such that using different numbers of M and C passes for the different types of regions provides a faster printing time than using C passes for both types of regions.

If multiple printmodes per swath are utilized for printing a particular swath, a color printmode providing the C passes is used to print the color regions, while a monochrome printmode providing the M passes is used to print the monochrome regions. The appropriate printmode is activated when the printhead arrangement moves across a boundary into a different region. Examining the process of printing the swath in more detail, the region corresponding to the current location in the scan direction of the printhead is selected from the ordered set of regions comprising the swath. A current printmode corresponding to the printmode for the region is activated, and the printhead arrangement is scanned in a current scan direction, emitting drops of ink from the printhead arrangement during scanning, as controlled by the current printmode. When the boundary of the current region is reached, the method determines the next action to take based on the current printmode. This next action will either be to retain the current printmode and reverse the scan direction, or activating the printmode corresponding to the next region in the ordered set and continuing to scan in the same direction.

The monochrome and color printmodes are incorporated in a bidirectional swath printer which is an alternate embodiment of the present invention. The printer includes a frame, a carriage attached to the frame for relative motion with respect to the print medium in oscillating scans along a scan axis, a printhead arrangement mounted to the carriage for controllably depositing drops of different color inks on the print medium during motion of the printhead arrangement, and a print controller operatively connected to the carriage and the printhead arrangement for moving the carriage and depositing the drops. The print controller further includes a data buffer for receiving the data swaths, the monochrome and color printmodes, and an ink deposition controller which activates the monochrome printmode when printing monochrome regions and the color printmode when printing the color regions. Some embodiments of the printer also include a data sorter for receiving the swaths and detecting the monochrome and color regions, a color data plane for receiving the color regions, and a monochrome data plane for receiving the monochrome regions. All pixels in a monochrome region have RGB color attributes of 0,0,0, while at least some pixels in a color region have RGB color attributes of other than 0,0,0. The printer may also include an analyzer coupled to the data buffer and the ink deposition controller for receiving the swaths, analyzing the swaths to determine the state of the multiple-printmode-per-swath control flag that governs whether both color and monochrome printmodes will be used to print the respective regions in the swath, or whether all regions in the swath will be printed using only the color printmode, and communicating the control flag to the ink deposition controller. The printhead arrangement contains at least one print cartridge with at least one ink ejection element array; the axis of the array is orthogonal to the relative motion of the carriage. The printer typically also includes a media advance arrangement attached to the frame and coupled to the print controller for advancing the medium relative to the carriage along an advance axis which is orthogonal to the scan axis.

BRIEF DESCRIPTION OF THE DRAWINGS

The above-mentioned features of the present invention and the manner of attaining them, and the invention itself, will be best understood by reference to the following detailed description of the preferred embodiment of the invention, taken in conjunction with the accompanying drawings, wherein.

DESCRIPTION OF THE PREFERRED EMBODIMENT

Figure 1A:
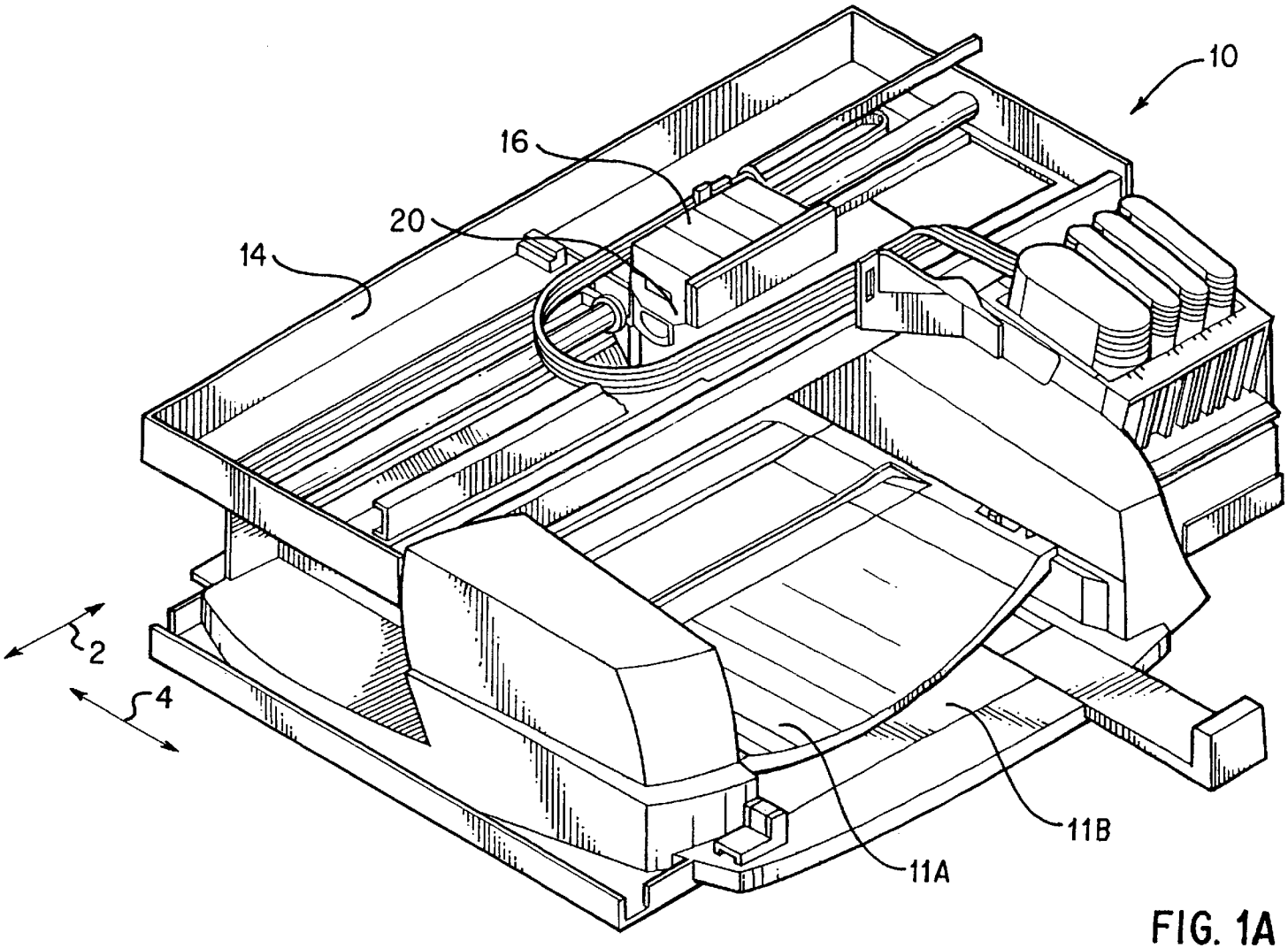
FIG. 1A is a perspective view of a novel desktop swath printer according to the present invention.
Figure 1B:
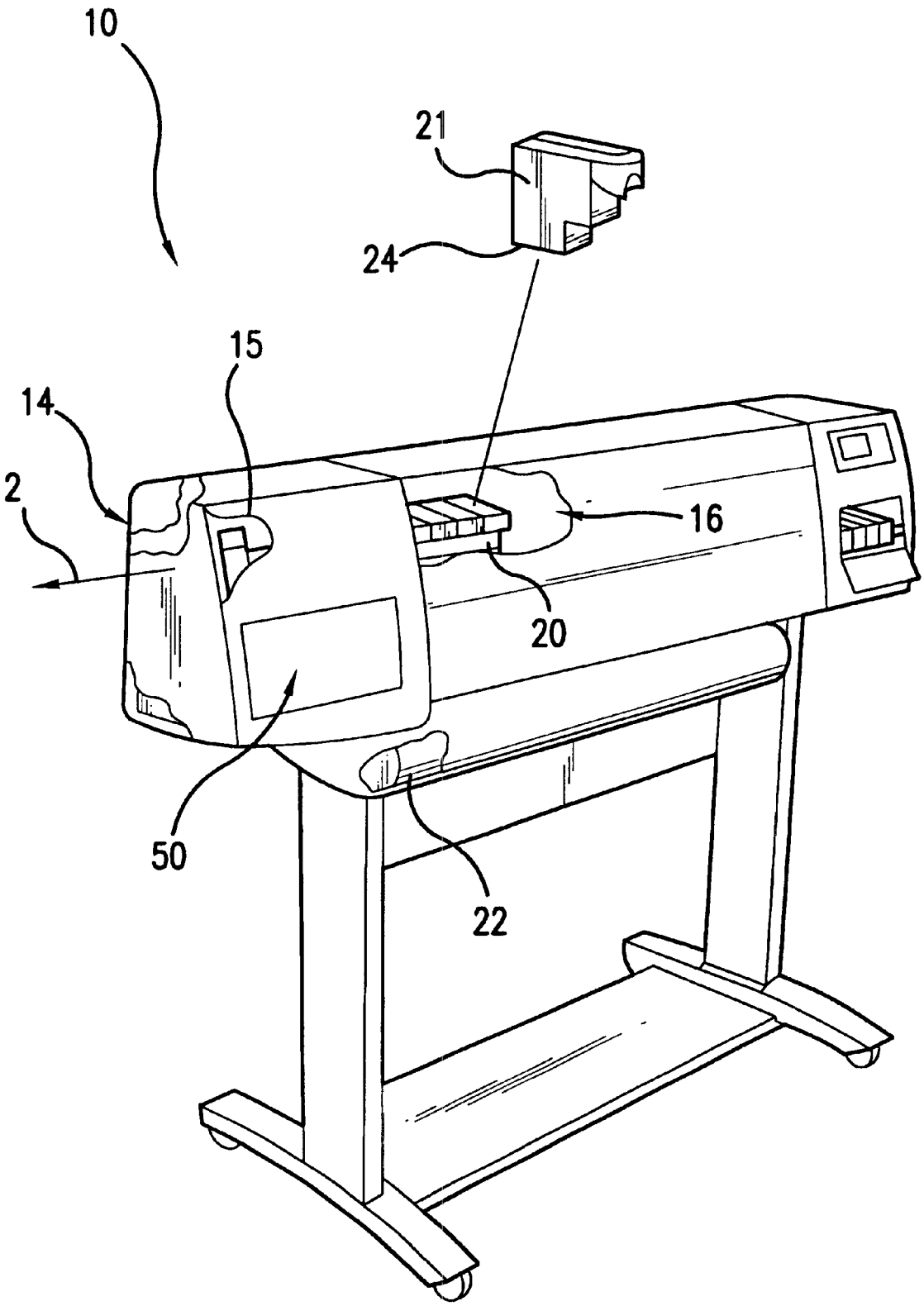
FIG. 1B is a perspective view of a novel large-format swath printer according to the present invention.
Figure 2:
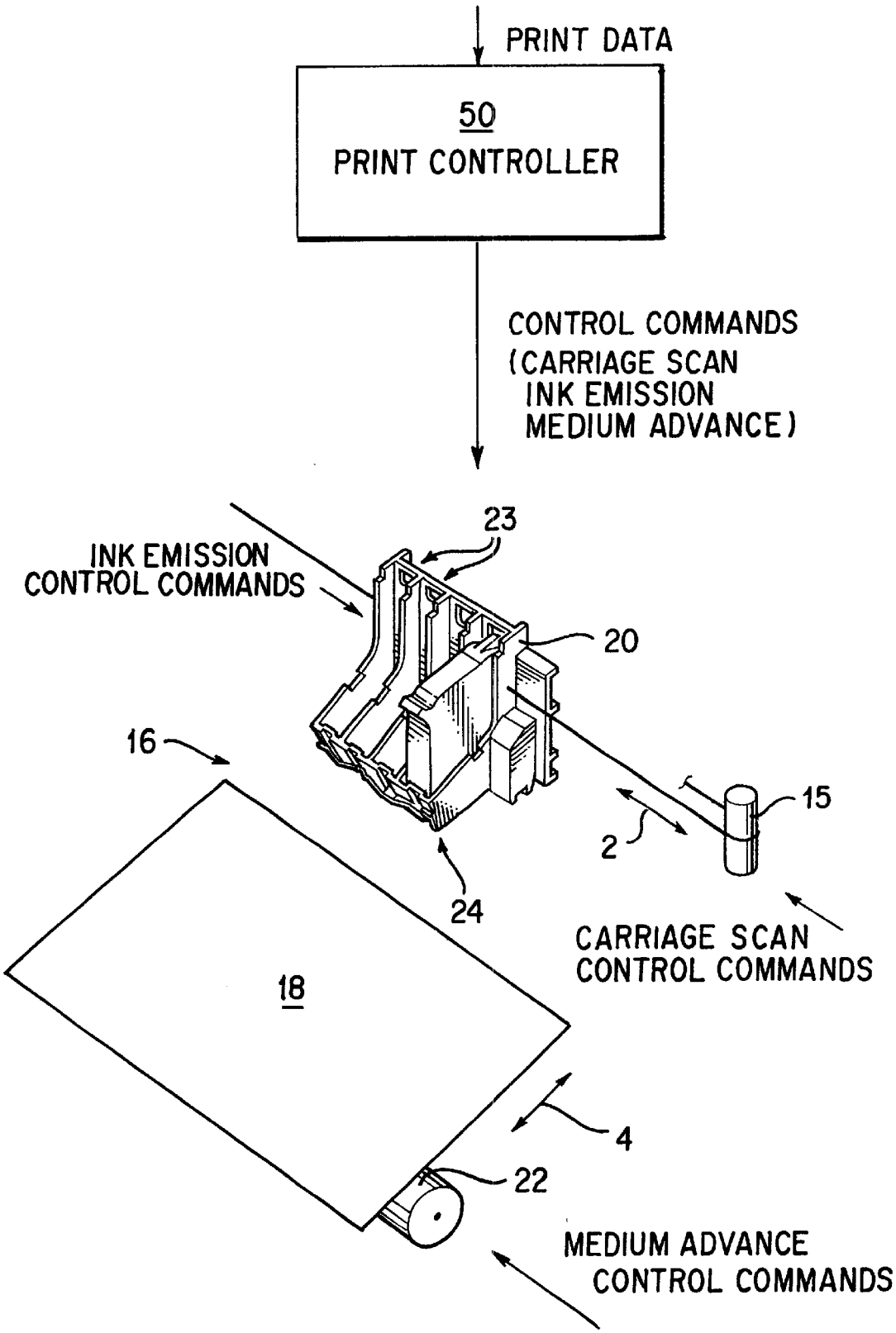
FIG. 2 is a schematic block diagram representation of certain elements, including a print controller and a printhead arrangement, of the printer of FIG. 1.

Referring now to the drawings, there is illustrated a novel bidirectional swath printer 10 constructed in accordance with the present invention, and operated in accordance with a novel method 600 for printing on a print medium using multiple printmodes-per-swath. When printing a single swath that contains at least two sections of different types of print data, such as one section of monochrome text and another section of color photographic image, the printer 10 and method 600 advantageously use different printmodes optimized for each type of data so as to increase the printing speed and ensure a consistent visual appearance from swath to swath.

Considering now a preferred embodiment of the printer 10 in greater detail with reference to FIGS. 1A–B, 2, and 3, the printer 10 generally includes a carriage 20 mounted in a frame 14 for relative motion with respect to a print medium 18 such as paper, transparency film, or textiles in back-and-forth scans along a scan axis 2 by a carriage scan mechanism 15, a printhead arrangement 16 mounted to the carriage 20 for controllably depositing drops of different color inks on the print medium 18, and a print controller 50 connected to the carriage 20 and the printhead arrangement 16 for moving the carriage 20 and depositing the ink drops on the medium 18. The novel print controller 50 has a data buffer 52 for receiving the swaths of the data to be printed on the medium 18, one or more monochrome printmodes 54 for depositing the drops for the monochrome region in a relatively fewer number of scans, one or more color printmodes 56 for depositing the drops for the color region in a relatively greater number of scans, and an ink deposition controller 58 which activating the monochrome printmode when printing the monochrome region of an individual swath and the color printmode when printing the color region of the swath.

In operation in accordance with the novel method 600 of the present invention, the printer 10 processes each swath of data to determine the monochrome regions and color regions in the swath and then prints the data while moving the printhead arrangement 16 relative to the medium 18 in the forward or backward scan direction 2, moving over color printing areas on the medium 18 corresponding to color data regions a relatively greater number of times and moving over monochrome printing areas on the medium 18 corresponding to monochrome data regions a relatively fewer number of times so as to minimize printing time. In printers 10 with a longer path of travel along the scan axis 2, such as the large-format printer 10 of FIG. 1B, the time savings can be even more significant.

Considering now in further detail the printer 10, and with reference to FIGS. 1A–B, 2, and 4A–B, a supply of the medium 18 can be received in input tray 11B, and after printing is moved to output tray 11A by the medium advance mechanism 22 which advances the medium along a medium advance axis 4 which is generally orthogonal to the scan axis 2. With regard to the printhead arrangement 16 of the preferred embodiment, the carriage 20 contains one or more stalls 23, each stall 23 for receiving a printhead cartridge 21. A printhead cartridge 21 may contain one or more arrays of ink ejection elements 24, such as a single array of ink ejection elements 24*a* for depositing drops of one color ink, or multiple arrays of ink ejection elements 24*b* for typically depositing drops of several different color inks. Each ink ejection element is fluidically coupled to a supply of the appropriate ink, and has a nozzle through which the ink can be emitted during printing. The deposition of ink drops from the printhead arrangement 16, the movement of the carriage 20 by the carriage scan mechanism 15, and the movement of the medium 18 by the medium advance mechanism 22 are controlled by control commands generated by the print controller 50 as it processes the various data swaths. The issuance of control commands by the print controller 50, and the details of the scan mechanism 15 and advance mechanism 22, are known to those skilled in the art, and will not be discussed further herein.

Figure 5:
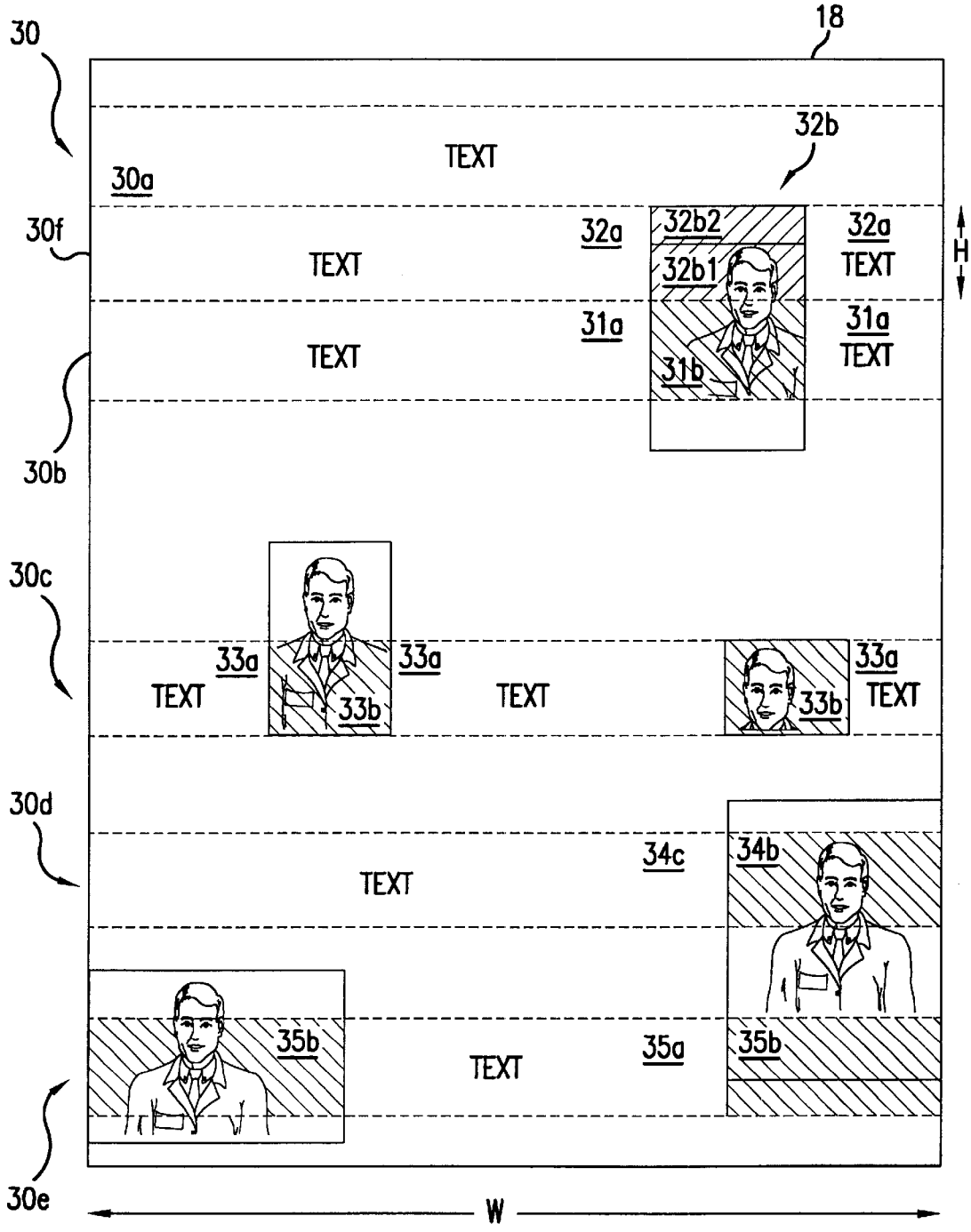
FIG. 5 is a schematic representation of exemplary print data swaths printed on a medium by the printer of FIG. 1.

Considering now in further detail the print data representing the information to be printed, and with reference to the exemplary print data printed on the medium 18 of FIG. 5, the print data is printed by the printer 10 in swaths, the printed output of a number of which are indicated generally at 30. Swaths 30 can contain either monochrome text regions (such as in swath 30*a*), color image regions, or both (such as in swath 30*b*). Monochrome regions are printed in corresponding monochrome printing areas on the medium 18, while color regions are printed in corresponding color printing areas on the medium 18. In swaths 30 containing both monochrome and color regions, there can be different numbers and locations of each type of region. For example, swath 30*b* has one color region 31*b* located between two monochrome regions 31*a*. Swath 30*c* has two color regions 33*b* located between three monochrome regions 33*a*. Swath 30*d* has a monochrome region 34*a* at one end and a color region 34*b* at the other end of the swath. Swath 30*e* has a monochrome region 35*a* between two color regions 35*b*. A region occupies the full height H of the swath and a portion of the width W of the swath, and if any portion of a region contains color data, it is processed as a color region. For example, in swath 30*f* which has two monochrome regions 32*a* and one color region 32*b*, color region 32*b* contains color print data in its bottom half 32*b*1, but monochrome print data in its top half 32*b*2. The height H of the swaths is determined by the height of the ink ejection element arrays 24*a,b* and the interrelationship between movement of the medium 18 in the advance direction 4 and the emission of ink drops from the arrays 24*a,b*. As will be explained subsequently in further detail, fully printing a swath 30, particularly the color region, typically involves multiple passes of the printhead array 16 over the media 18. The preferred embodiment of the present invention uses full height advance, in which the media is advanced an amount equivalent to the height of the ink ejection element array only after each swath is completely printed, so in this case the swath height H equals the ink ejection element array height. An alternate embodiment of the present invention uses fractional advance, in which the media is advanced an amount equivalent to a fraction of the height of the ink ejection element array at certain times when the carriage is reversing direction during the printing of the swath.

Figure 3:
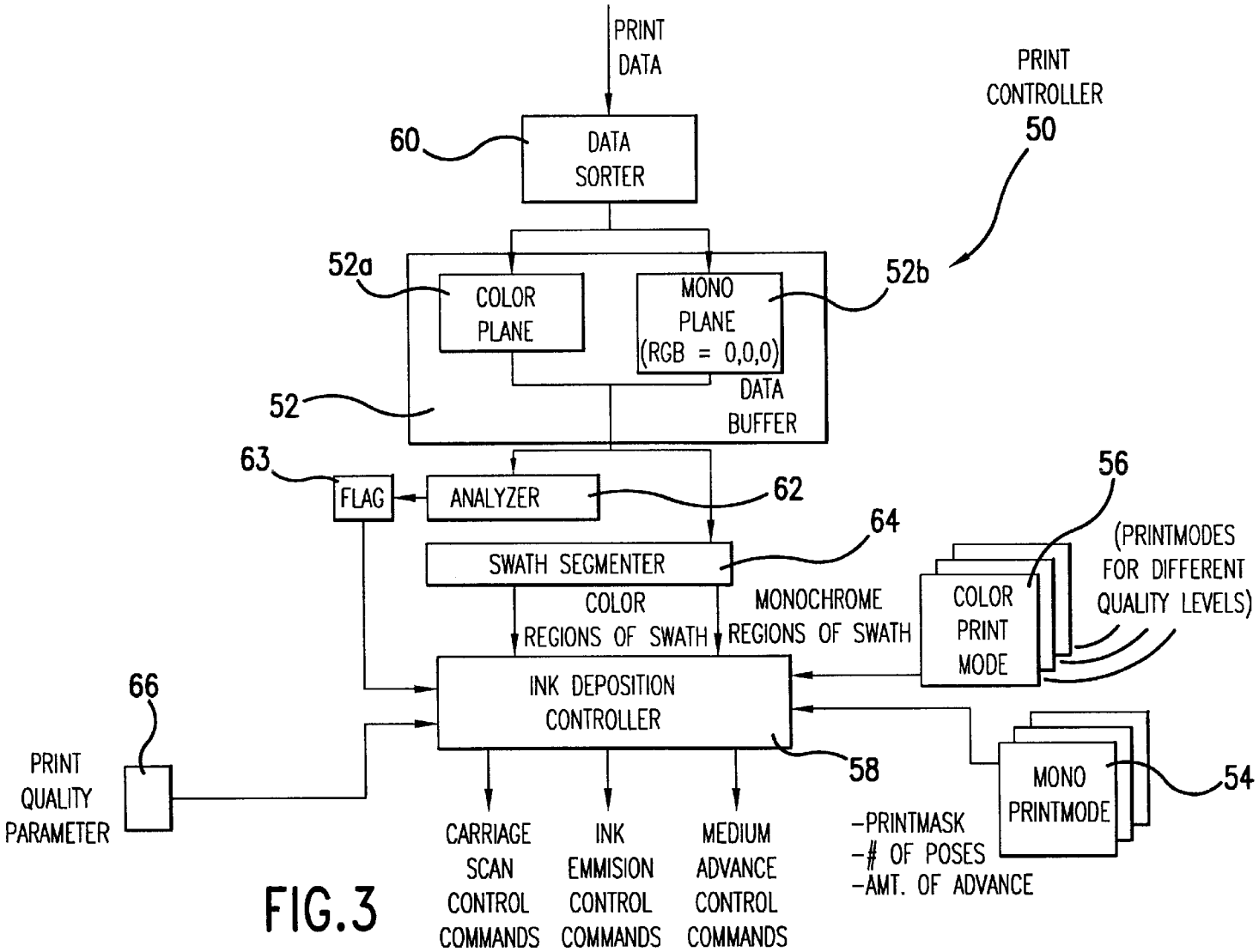
FIG. 3 is a more detailed block diagram representation of the print controller of FIG. 2.
Figure 4B:
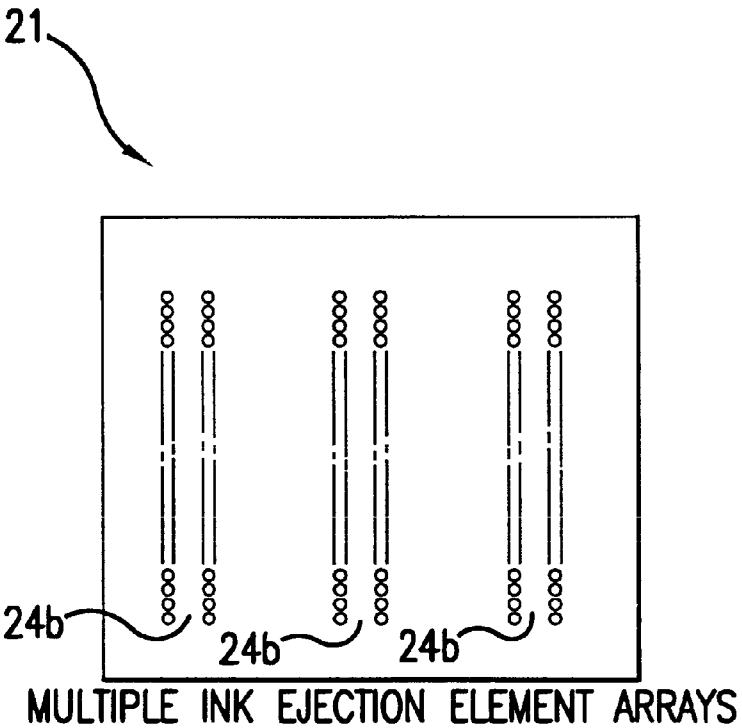
FIGS. 4A and 4B are schematic representations of ink ejection element arrays of the printhead arrangement of FIG. 2.
Figure 4A:
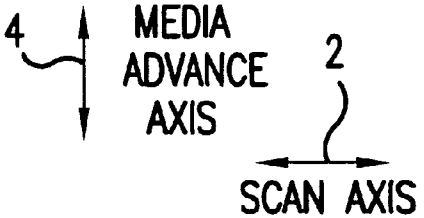
Figure 4A:
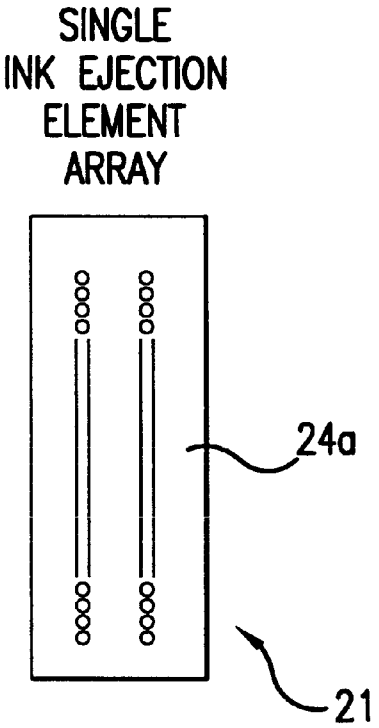

Considering now in further detail the print controller 50, with reference to FIG. 3 and bearing in mind the previous discussion regarding swaths and regions, the print data is received by a data sorter 60. The print data is composed of a number of individual information elements called pixels, each of which has attributes which describe the color and intensity to be printed at a specified row-and-column position on the medium 18. The data sorter 60 processes the pixels to detect the heretofore described color regions, the pixels of which it places in a color plane 52*a* of the data buffer 52. Similarly, the sorter 60 detects monochrome regions, the pixels of which it places in a monochrome plane 52*b* of the data buffer 52.

An analyzer 62 analyzes the characteristics of the regions in the color plane 52*a* and the monochrome plane 52*b* in order to determine whether using multiple printmodes-per-swath would result in a faster printing time. In the preferred embodiment, the analyzer assesses the entire set of print data to decide whether or not to utilize multiple printmodes-per-swath when printing the image. In an alternate embodiment, the analyzer 62 makes this decision on a swath-by-swath basis. Performing this assessment on the entire set of print data can be more computationally intensive, but it avoids the objectionable print quality that can result from printing some text portions with the monochrome printmode and other text portions with the color printmode. The analyzer enables a multiple-printmode-per-swath control flag 63 if a ratio of the size of the monochrome region to the size of the color region exceeds a threshold value, and disables the control flag otherwise. The analyzer communicates the control flag 63 to the ink deposition controller 58 for use during swath printing, as will be discussed subsequently in further detail.

In some implementation, the sorter 60 may additionally optimize the division of the print data into regions by combining what would otherwise become narrow monochrome regions together with adjacent color regions to form a larger color region. The sorter 60 does this in situations where printing these small potential monochrome regions with a monochrome printmode would adversely affect the printing time due to the reversal of carriage 20 travel when changing from the color to the monochrome printmode for these small regions.

The print controller 50 also includes a swath segmenter 64 which receives the color and monochrome regions of print data from the data buffer and segments this data into swaths 30 for printing on the medium 18 by the ink deposition controller 58.

Considering now in further detail the ink deposition controller 58, the controller 58 receives the color and monochrome regions of the swath and generates the signals needed to control the scan mechanism 15, the printhead arrangement 16, and the advance mechanism 22 in order to print these regions on the media 18 in a high quality manner. If the control flag 63 enables multiple-printmode-per-swath printing, then the controller 58 uses a specified one of a set of color printmodes 56 to print the color regions of the swath, and a specified one of a set of monochrome printmodes 54 to print the monochrome regions of the swath. If the control flag 63 disables multiple-printmode-per-swath printing, then the controller 58 uses a specified one of a set of color printmodes 56 to print both the color and the monochrome regions of the swath (the monochrome printmode 54 would be used only if the entire print data, or alternatively the swath, contained no color data). The particular one of each set of printmodes to be used for printing is selected by a print quality parameter 66 (which is preferentially specified by the user). The selected printmodes generally determine the number of scans required to print a region, the printmask which determines what pixels are enabled for printing during each scan, and the amount and timing of medium advances. Typically, where N scans are required to print a region, approximately 1/Nth of the region is printed during each scan in the forward or the backward direction. For example, if four passes are used to print the color region (C=4), then approximately one-fourth (or 25%) of the pixels in the color region are enabled to be printed during each of the four passes by the printmask associated with the particular color printmode. The general operation of printmodes and printmasks is well known in the art, as demonstrated by the commonly-owned U.S. Pat. No. 5,555,006 issued to Cleveland et al. which is hereby incorporated by reference in its entirety, and will not be discussed in further detail herein.

Figure 6:
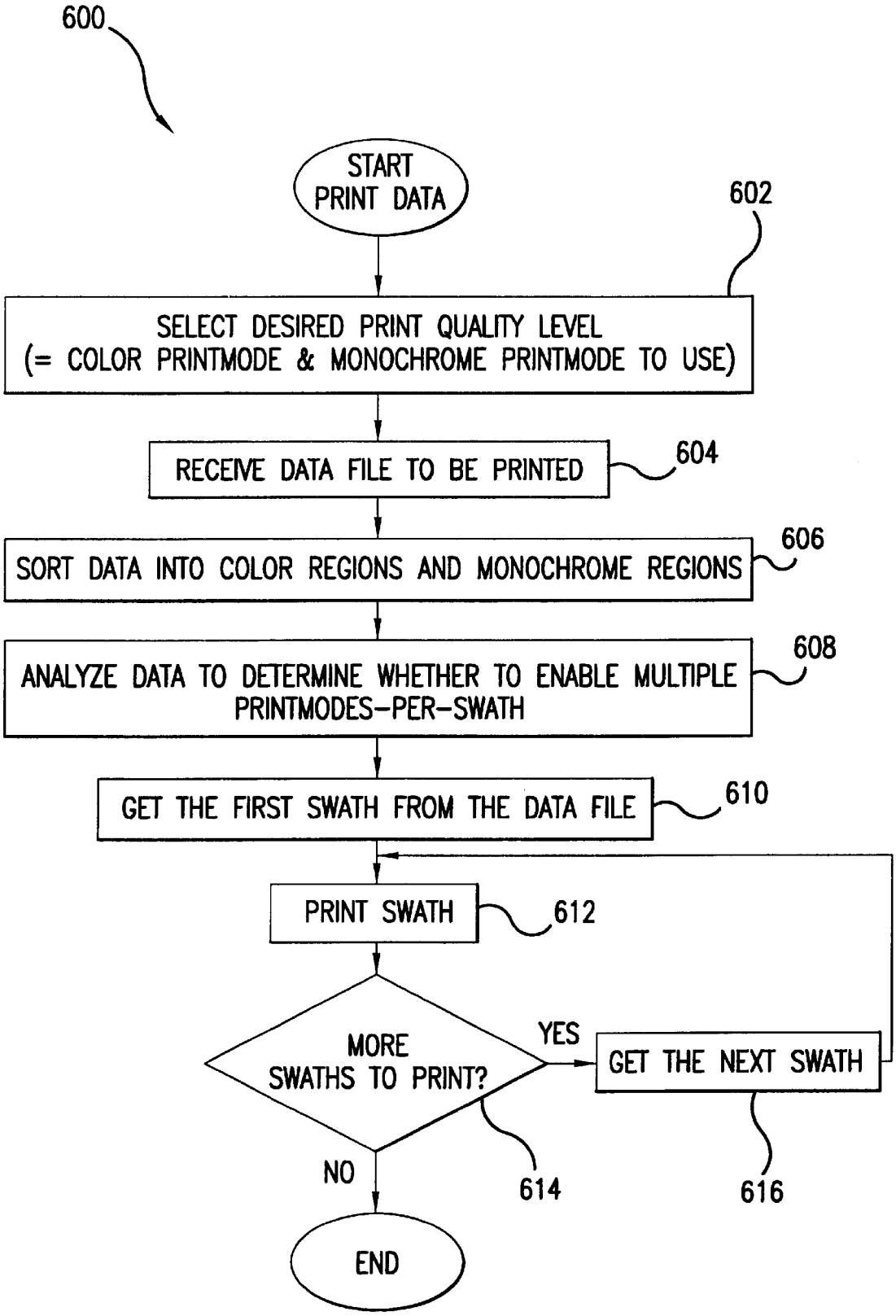
FIG. 6 is a flowchart of a novel method of printing with multiple printmodes per swath usable with the swath printer of FIG. 1.

Considering now the novel method 600 for printing combined monochrome and color data on a print medium using multiple printmodes-per-swath in accordance with the present invention, and with reference to FIG. 6, at 602 the desired print quality level to use for the color printmode 56 and the monochrome printmode 54 is selected. A higher level of print quality typically involves using a greater number of scans to fully print a region, while a lower level of print quality typically involves using a lesser number of scans to fully print a region. The selected print quality level is preferentially stored in the parameter 66 as heretofore described. At 604, the data to be printed is received, preferably by the print controller 50. At 606, the data is sorted into color regions and monochrome regions, and at 608 the color and monochrome region data is analyzed as heretofore described in order to determine whether multiple printmodes-per-swath printing will be enabled or disabled. At 610 the data for the first swath is obtained, and printed at 612. If there are more swaths to print ("Yes" branch of 614), then the next swath is obtained, and the method loops back to 612 in order to print the next swath. If there are no more swaths to print ("No" branch of 614), the method is completed.

Figure 7:
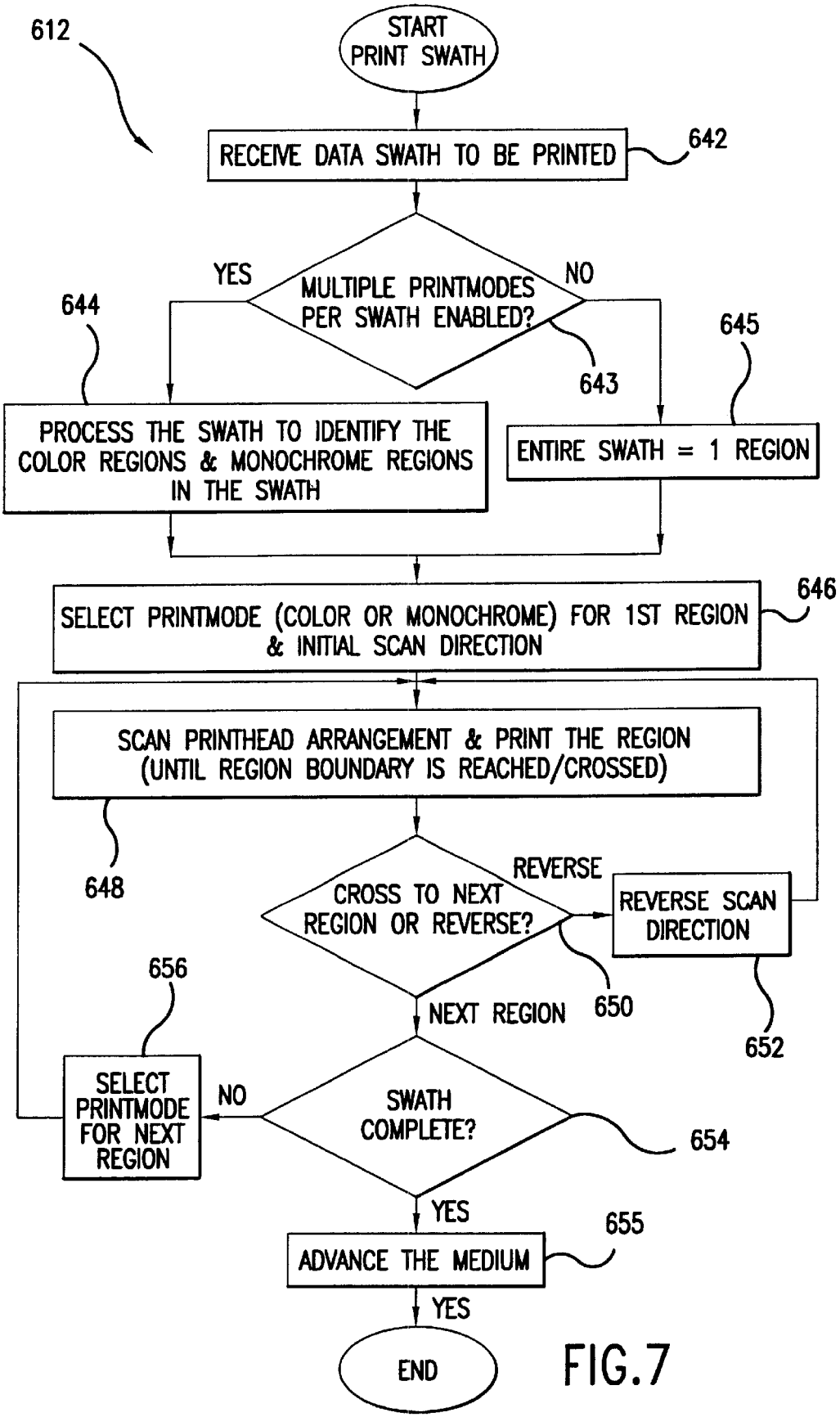
FIG. 7 is a more detailed flowchart of printing a swath according to FIG. 6.

Considering now in further detail the printing of the swath at 612, and with reference to FIG. 7, at 642 the data for the swath is received from the swath segmenter 64. If multiple printmodes-per-swath are enabled ("Yes" branch of 643), then at 644 the ink deposition controller 58 processes the swath to locate the various color and monochrome regions within the swath, and determine the order of the various regions within the swath (for example, from one end of the swath to another). Typically, the color and monochrome regions will be alternating. If multiple printmodes-per-swath are disabled ("No" branch of 643), then at 645 the entire swath will be subsequently processed as a single color region if the swath contains any color data (only if the swath contains solely monochrome data will it be processed as a single monochrome region). Processing continues from both 644 and 645 at 646, where the first region in the swath (that region located at the swath end nearest the starting point of the carriage 20) is identified and prepared for printing. If the region is a color region, the color printmode 56 for the selected print quality level will specify the number of scans required to print the color region; conversely, if the region is a monochrome region, the monochrome printmode 54 for the selected print quality level will specify the number of scans required to print the monochrome region. At 648, the printhead arrangement 16 is scanned across the medium 18 until the region boundary is reached so as to print the region. When the boundary is reached at 650, the method determines whether to cross the boundary into the next region and select a new printmode to print the next region, or retain the current printmode and reverse the scan direction to continue printing the current region. This is determined based on the printmode currently in effect, the current number of passes that have been made in the region up to this point, and whether or not the physical limits of carriage 30 travel have been reached, as will be discussed subsequently. If the method will continue printing the current region ("Reverse" branch of 650), the current printmode is retained and scan direction is reversed at 652, and printing the current region continues at 648. If the method will print the next region ("Next Region" branch of 650), another check is made to see whether printing of the swath is complete. If not ("No" branch of 654), the printmode corresponding to the type of the next region is enabled at 656, the current scan direction is retained, and printing the next region starts at 648. If swath printing is complete ("Yes" branch of 654), the printhead arrangement 16 is advanced relative to the medium 18 by an appropriate amount at 655, and the method ends.

Considering now in further detail the monochrome printmodes 54 and the color printmodes 56, as mentioned heretofore each of the printmodes generally determine, among other things, the number of scans required to print a region. The print controller 50 may support multiple color printmodes 54, each having a different quality levels (for example, "draft", "normal", and "best"); and the same for monochrome printmodes 54. A color printmode 56 of a given quality level typically requires more scans than a monochrome printmode 54 of the equivalent quality level. A number of different compatible pairs of monochrome printmodes 54 and color printmodes 56 can be advantageously utilized to minimize printing speed; the color or monochrome printmode of a pair is selected when region boundaries are crossed, as described previously. The location of a color region in the swath (for example, in the middle portion of a swath between two monochrome regions, or at an end portion of a swath) also is a factor in determining useful combinations of color 56 and monochrome 54 printmodes. In addition, the number of different regions in a swath also impacts printing time.

With regard to printmode combinations which are useful in the more general case of a color region located in a middle portion of a swath between two monochrome regions, and with particular reference to FIGS. 8A through 8D illustrating a printing operation using several such printmode combinations, arrows 80 depict the direction of carriage 30 travel during each of the numbered passes 81 while printing the indicated monochrome regions 32*a* and color region 32*b* on the medium 18. The location of the printhead arrangement 16 in the advance direction 4 is also depicted during the printing of a first swath 83 and a second swath 84. In the 1-pass monochrome/3-pass color printmode combination of FIG. 8A, the print controller 50 initially selects a 1-pass monochrome printmode 54 and prints the left-most monochrome region 32*a*1. At the boundary of the color region 32*b*, the controller 50 determines (based on the total number of passes in the current printmode, the number of passes in the current region up to this point, and the position of the carriage with respect to the physical limits of carriage 30 travel) that it should switch to a 3-pass color printmode, retain the current left-to-right scan direction, and print the first pass of the color region 32*b*. After the first pass through the color region 32*b* to the boundary of the right-most monochrome region 32*a*2, the controller 50 determines that it should reverse the scan direction and retain the current color printmode to print the second pass of the color region 32*b*. After the second pass through the color region 32*b* to the boundary of the left-most monochrome region 32*a*1, the controller 50 again determines that it should reverse the scan direction and retain the current color printmode to print the third pass of the color region 32*b*. After the third pass through the color region 32*b* to the boundary of the right-most monochrome region 32*a*2, the controller 50 determines that it should switch back to the 1-pass monochrome printmode, retain the current left-to-right scan direction, and print the first pass of the right-most monochrome region 32*a*. After the pass through the right-most monochrome region 32*a*2 to the end boundary of the swath, all regions have been fully printed and the printhead arrangement 16 is advanced relative to the media in the advance direction 4 a distance equivalent to the height of the printhead arrangement, and printing of the next swath begins in an analogous manner as indicated by the arrows.

Figure 8A:
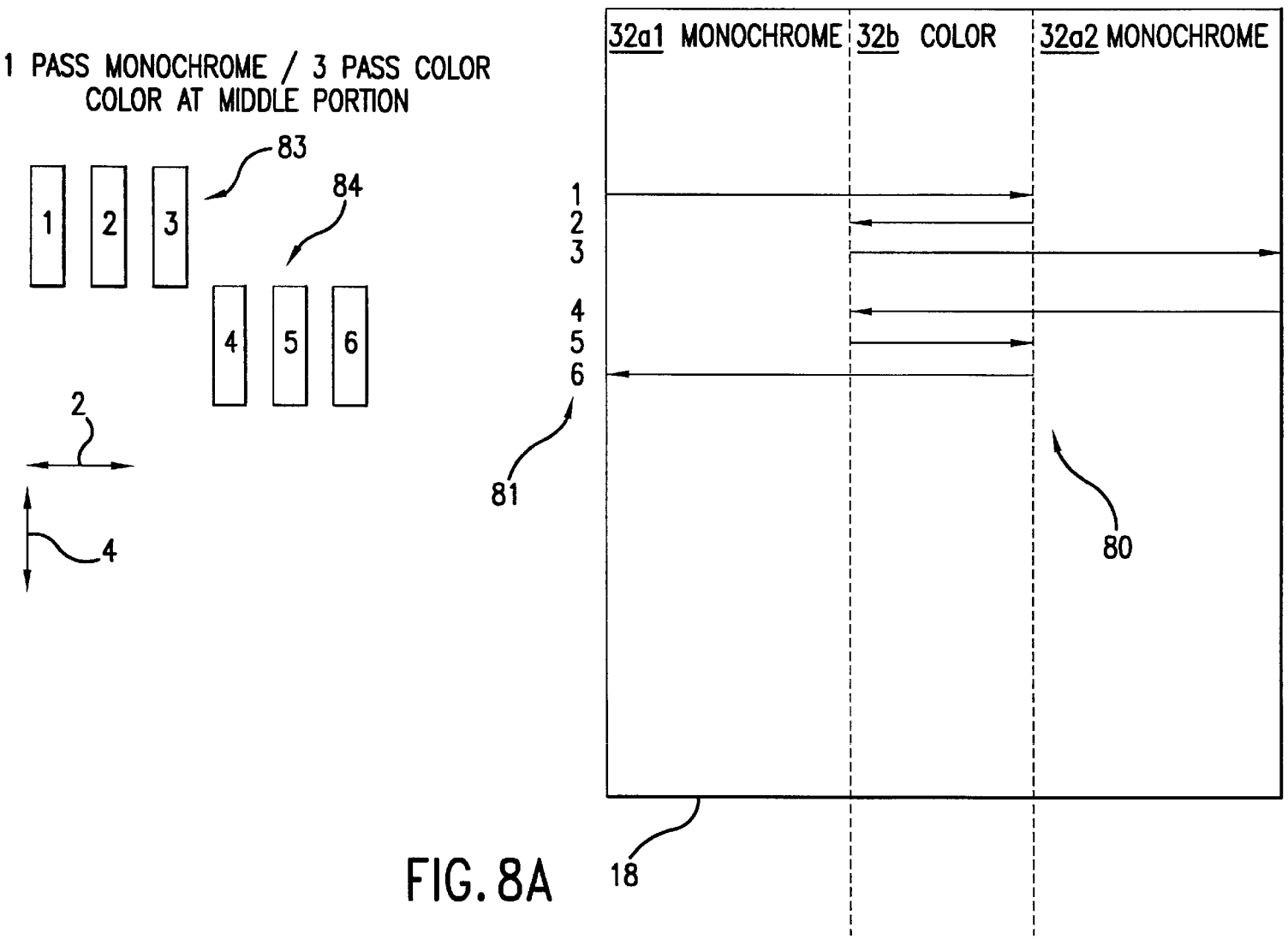
FIGS. 8A through 8D are schematic representations of printing a swath having a single color region located between two monochrome regions using four different combination printmodes according to the method of FIGS. 6 and 7.
Figure 8B:
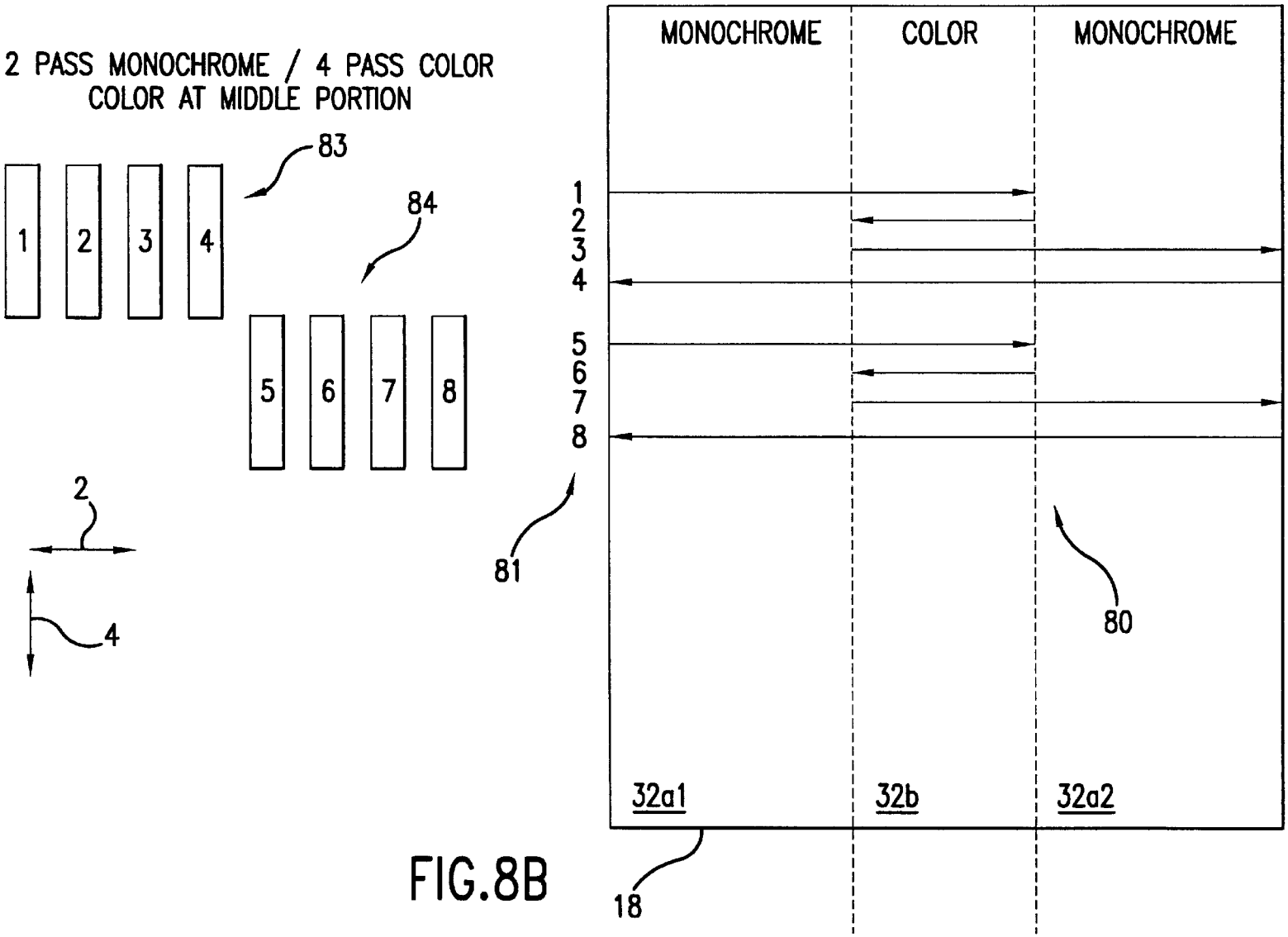
Figure 8C:
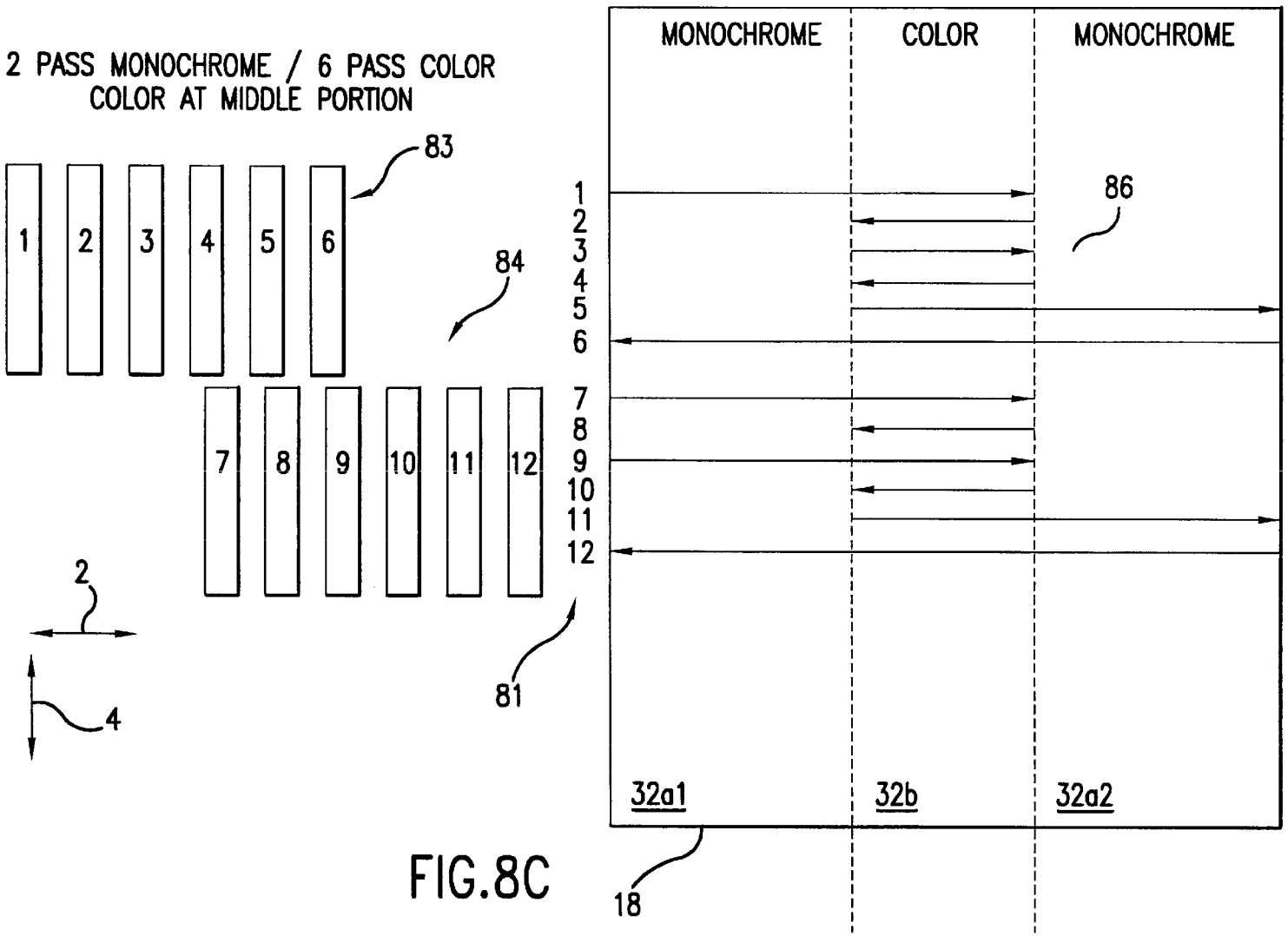
Figure 8D:
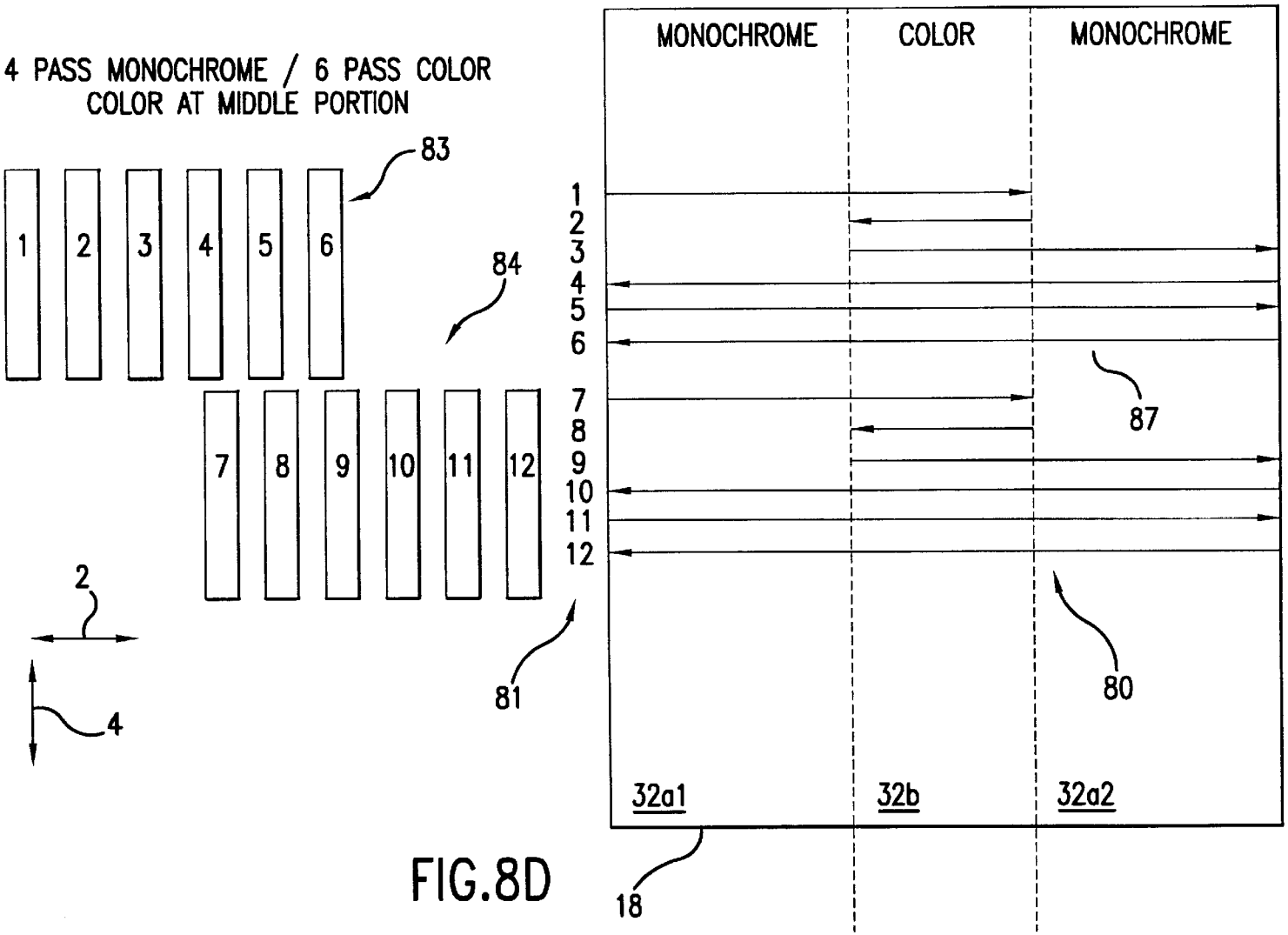

Another useful combination of the general case of a color region located in a middle portion of a swath between two monochrome regions is the 2-pass monochrome/4-pass color printmode combination illustrated in FIG. 8B, the operation of which is analogous to the previous description of the 1/3 combination of FIG. 8A. Further useful combinations can be easily derived from these 1/3 and 2/4 combinations. For example, FIG. 8C depicts a 2-pass monochrome/6-pass color printmode combination which is based on the 2/4 combination, with an additional two back-and-forth passes 86 in the color region 32*b*. Additional color passes, such as to make a 2/8 combination (not illustrated), can be added by repeating the two back-and-forth passes 86 additional times. In addition, additional monochrome as well as color passes can be added, as depicted for the 4-pass monochrome/6-pass color printmode combination illustrated in FIG. 8D, which is also based on the 2/4 combination with an additional two back-and-forth passes 87 in all the regions. Additional passes, such as to make a 6/8 combination (not illustrated), can be added by repeating the two back-and-forth passes 87 additional times. While a large number of printmodes combinations are possible, not every combination of printmodes is advantageous; useful combinations of printmodes minimize reversals in the direction of carriage 20 travel, and avoid carriage 20 motion if data is not being concurrently printed. For the general case of one color region 32*b* between two monochrome regions 32*a*1,2, and for a monochrome printmode 54 having M passes, useful printmode combinations require a color printmode 56 using M+2N color passes, where N is an integer greater than zero.

Figure 9A:
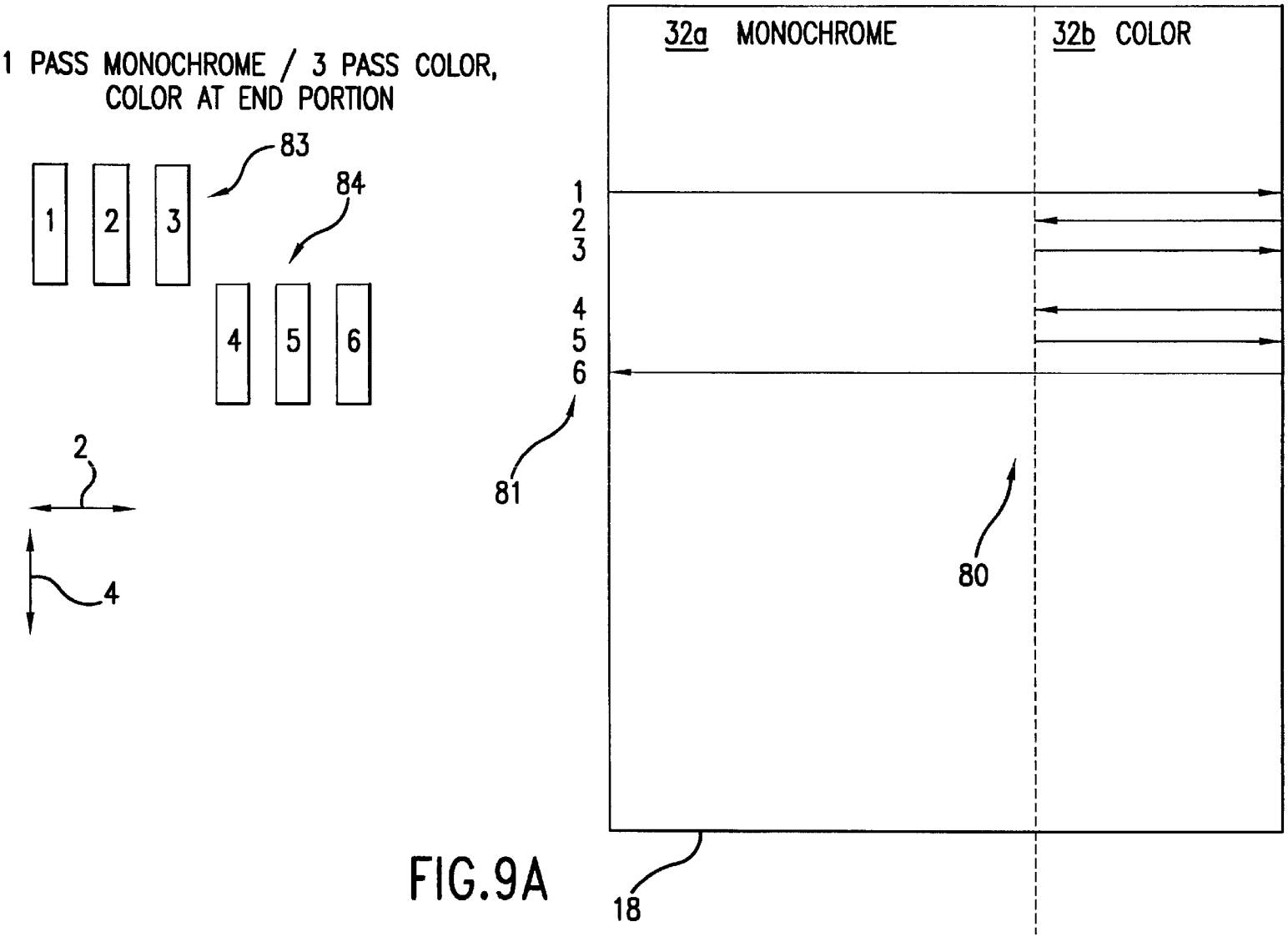
FIGS. 9A and 9B are schematic representations of printing a swath having a single color region and a single monochrome region using two different combination printmodes according to the method of FIGS. 6 and 7.
Figure 9B:
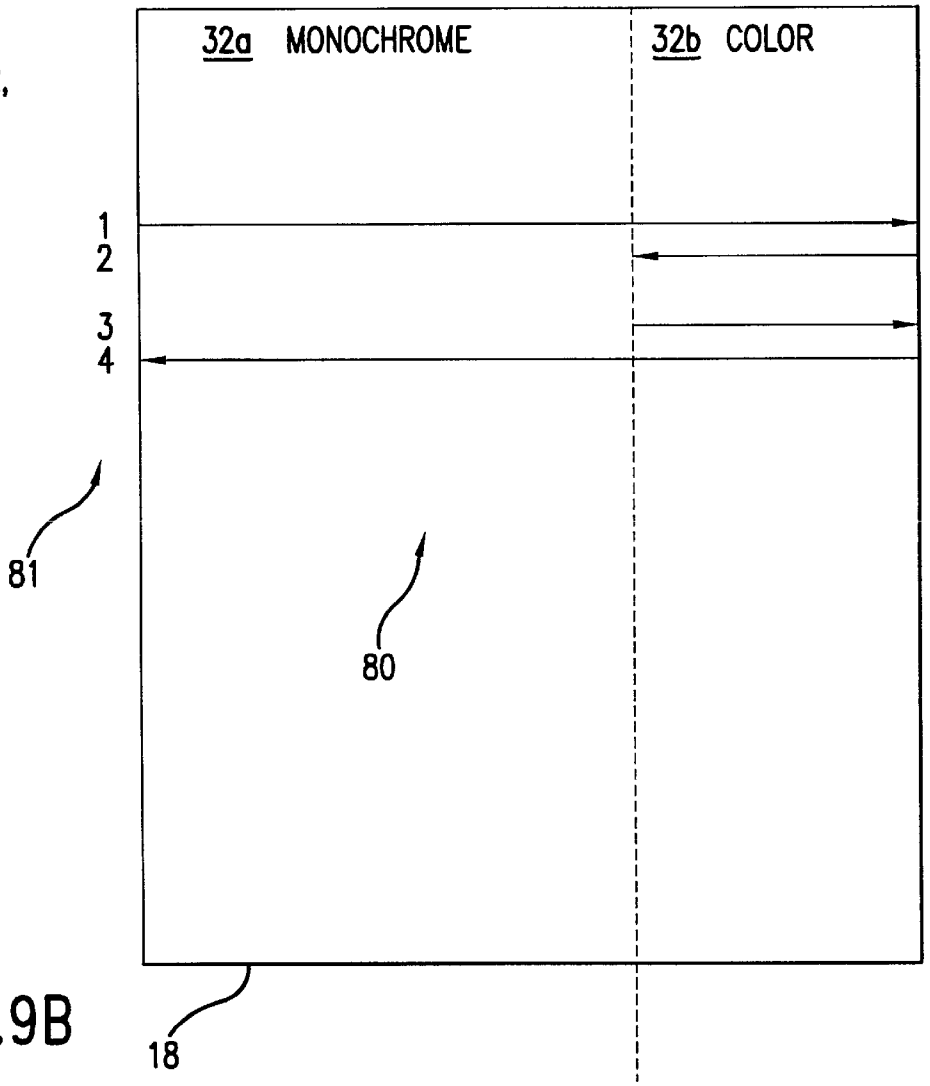
Figure 9B:
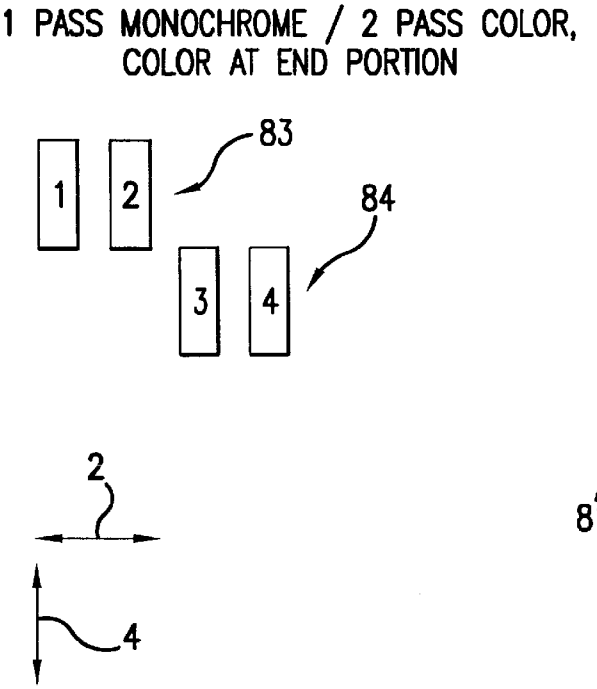
Figure 10:
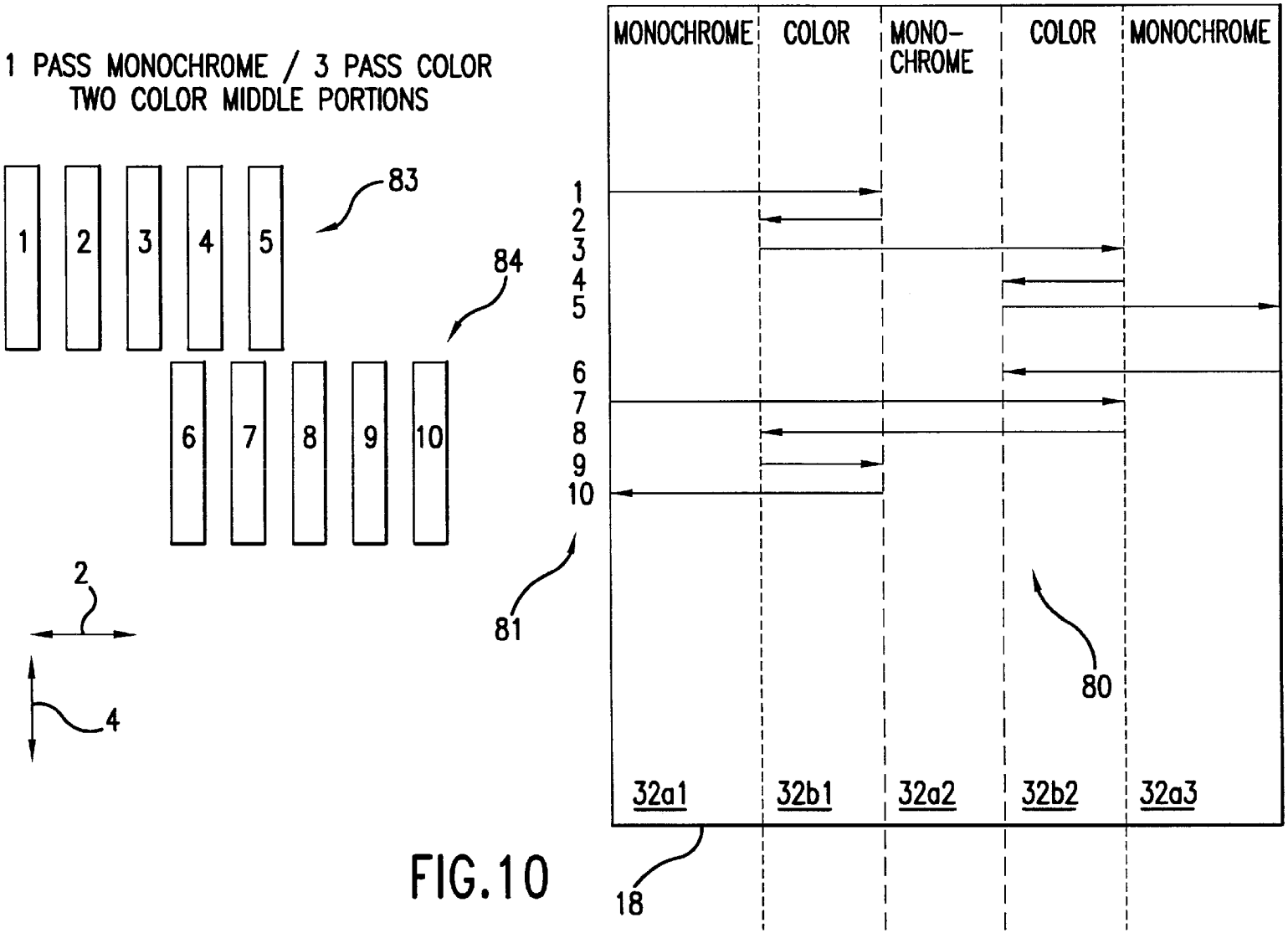
FIG. 10 is schematic representations of printing a swath having two color regions and three monochrome regions using a combination printmode according to the method of FIGS. 6 and 7.

With regard to the special case of a single color region located at one end portion of a swath also containing one monochrome region, the printmode combinations for the general case just described are also useful. For example, FIG. 9A illustrates the application of the 1/3 printmode combination of FIG. 8A to a swath having two regions, a color region 32*b* at one end of the swath and a monochrome region 32*a* at the other end. However, some additional useful printmode combinations exist for the special case. For example, a useful 1-pass monochrome/2-pass color printmode combination is illustrated in FIG. 9B. Additional color passes, or monochrome and color passes, can easily be added in the same manner as has already been illustrated for the general case in FIGS. 8C and 8D. For the special case of a single color region 32*b* located at one end of a swath also containing one monochrome region 32*a*, and for a monochrome printmode 54 having M passes, useful printmode combinations require a color printmode 56 using M+N passes for odd values of M, or M+2N color passes for even values of M, where N is an integer greater than zero.

Where a swath contain more than one color region, the analysis performed by the analyzer 62 as to whether a multiple-printmodes-per-swath operating mode reduces printing time becomes more complex, due mostly to the number of direction reversals required to implement the combination printmode. For example, FIG. 10 illustrates a swath having three monochrome regions 32*a*1,2,3 and two color regions 32*b*1,2. Each monochrome region 32*a*1,2,3 is fully printed in a single scan, while each color regions 32*b*1,2 requires three scans to be fully printed. However, a total of five separate passes is needed to fully print the total swath, due to the spacing of the color regions 32*b*1,2 and the number of carriage 30 reversals such a combination printmode requires as a consequence. The threshold value for the ratio of the size of the monochrome regions 32*a*1,2,3 to the size of the color regions 32*b*1,2 in order to make multiple-printmodes-per-swath yield a reduction in printing time will generally become higher as the number of direction reversals increases for a given combination printmode.

From the foregoing it will be appreciated that the novel multiple-printmodes-per-swath printer and printing method provided by the present invention represent a significant advance in the art. Although several specific embodiments of the invention have been described and illustrated, the invention is not limited to the specific methods, forms, or arrangements of parts so described and illustrated. The invention is limited only by the claims.

What is claimed is:

1. A method for printing a swath of data with a printhead arrangement of a bidirectional swath printer, comprising:

processing the swath of data to identify a monochrome region and a color region;

moving the printhead arrangement relative to a medium in a forward or a backward scan direction over a color printing area a relatively greater number of times while printing the color region;

moving the printhead arrangement relative to the medium in the forward or the backward scan direction over a monochrome printing area a relatively fewer number of times while printing the monochrome region, so as to minimize printing time; and wherein the monochrome region and the color region can be printed during movement in either of the forward or the backward scan direction.

2. The method of claim 1, further including:

advancing the printhead arrangement relative to the medium in a medium advance direction substantially orthogonal to the scan direction.

3. The method of claim 2, wherein the advancing occurs after printing the swath of data.

4. The method of claim 2, wherein the advancing occurs at certain times when the printhead arrangement is reversing direction between the forward and backward scan directions.

5. A method for printing a swath of data with a printhead arrangement of a bidirectional swath printer, comprising:

processing the swath of data to identify a monochrome region and a color region;

moving the printhead arrangement relative to a medium in a forward or a backward scan direction over a color printing area a relatively greater number of times while printing the color region;

moving the printhead arrangement relative to the medium in the forward or the backward scan direction over a monochrome printing area a relatively fewer number of times while printing the monochrome region, so as to minimize printing time; and wherein the processing comprises determining whether a decrease in the printing time due to the moving over the monochrome printing area the relatively fewer number of times passes as compared to the relatively greater number of passes over the color printing area exceeds an increase in the printing time due to additional reversals in the scan direction resulting from moving over the monochrome region and the color region a different number of times.

6. A method for printing a swath of data with a printhead arrangement of a bidirectional swath printer, comprising:

processing the swath of data to identify a monochrome region and a color region;

moving the printhead arrangement relative to a medium in a forward or a backward scan direction over a color printing area a relatively greater number of times while printing the color region;

moving the printhead arrangement relative to the medium in the forward or the backward scan direction over a monochrome printing area a relatively fewer number of times while printing the monochrome region, so as to minimize printing time; and wherein the processing comprises verifying that a ratio of a size of the monochrome region to another size of the color region exceeds a threshold value.

7. The method of claim 6, further comprising:

if the ratio does not exceed the threshold value, omitting the moving over a monochrome printing area and the moving over a color printing area, and moving the printhead arrangement relative to the medium in the forward or the backward scan direction over both the color and monochrome printing areas the relatively greater number of times while printing both the color region and the monochrome region.

8. A method for printing a swath of data on a medium with a printhead arrangement having different color inks, comprising:

processing the swath of data to identify at least one color region and at least one monochrome region;

moving the printhead arrangement and the medium relative to each other along a scan axis over at least one corresponding color printing area C times while depositing drops of the different color inks so as to print a corresponding one of the at least one color regions;

moving the printhead arrangement and the medium relative to each other along the scan axis over at least one corresponding monochrome printing area M times, where M is less than C, while depositing drops of one of the different color inks so as to print a corresponding one of the at least one monochrome regions; and wherein the at least one color region is a single region located at an end portion of the swath, wherein N is an integer greater than zero, wherein C=M+N for odd values of M, and wherein C=M+2N for even values of M.

9. The method of claim 8, wherein the processing includes:

verifying that the number and locations in the swath of the at least one monochrome region and the at least one color region are such that the moving the printhead arrangement over the at least one monochrome printing area M times and the at least one color printing area C times provides a faster printing time than moving the printhead arrangement over both the at least one monochrome printing area and the at least one color printing area C times.

10. The method of claim 8, wherein at least one of the color data regions is located at a middle portion of the swath between two monochrome regions, wherein N is an integer greater than zero, and wherein C=M+2N.

11. The method of claim 8, wherein approximately 1/Mth of each of the at least one monochrome regions is printed during each relative movement along the scan axis over a corresponding one of the at least one monochrome printing areas, and wherein approximately 1/Cth of the at least one color regions is printed during each relative movement along the scan axis over a corresponding one of the at least one color printing areas.

12. The method of claim 8, wherein the depositing drops of the different color inks uses a color printmode and the depositing drops of the one of the different color inks uses a monochrome printmode different from the color printmode.

13. The method of claim 12, further comprising:

activating the color printmode when moving along the scan axis across a border from a monochrome printing area into a color printing area; and activating the monochrome printmode when moving along the scan axis across a border from a color printing area into a monochrome printing area.

14. A bidirectional swath printer for printing data swaths on a print medium, comprising:

a frame;

a carriage attached to the frame for relative motion with respect to the print medium in oscillating scans along a scan axis;

a printhead arrangement mounted to the carriage for controllably depositing drops of different color inks on the print medium during motion of the printhead arrangement;

a print controller operatively connected to the carriage and the printhead arrangement for moving the carriage and depositing the drops, the print controller including a data buffer for receiving the data swaths, at least one individual data swath having at least one color region and at least one monochrome region, a monochrome printmode for depositing the drops for the monochrome region in a relatively fewer number of scans, a color printmode for depositing the drops for the color region in a relatively greater number of scans, and an ink deposition controller operatively coupled to the printmodes and the data buffer for activating the monochrome printmode when printing the monochrome region and the color printmode when printing the color region of the at least one individual data swath; and a data sorter for receiving the data swaths, detecting the at least one color region, and detecting the at least one monochrome region;

a color data plane operatively coupled to the data sorter for receiving the at least one color region; and a monochrome data plane operatively coupled to the data sorter for receiving the at least one monochrome region.

15. The bidirectional swath printer of claim 14, wherein the printhead arrangement further comprises at least one print cartridge, the at least one print cartridge having at least one ink ejection element array, the ink ejection element array having an axis substantially orthogonal to the relative motion of the carriage.

16. The bidirectional swath printer of claim 14, further including:

a media advance arrangement attached to the frame and operatively coupled to the print controller for advancing the print medium relative to the carriage along an advance axis orthogonal to the scan axis.

17. The bidirectional swath printer of claim 14, wherein all individual monochrome data pixels in the at least one monochrome region have RGB color attributes of 0,0,0 and wherein at least some individual color data pixels in the at least one color region have RGB color attributes of other than 0,0,0.

18. A bidirectional swath printer for printing data swaths on a print medium, comprising:

a frame;

a carriage attached to the frame for relative motion with respect to the print medium in oscillating scans along a scan axis;

a printhead arrangement mounted to the carriage for controllably depositing drops of different color inks on the print medium during motion of the printhead arrangement;

a print controller operatively connected to the carriage and the printhead arrangement for moving the carriage and depositing the drops, the print controller including a data buffer for receiving the data swaths, at least one individual data swath having at least one color region and at least one monochrome region, a monochrome printmode for depositing the drops for the monochrome region in a relatively fewer number of scans, a color printmode for depositing the drops for the color region in a relatively greater number of scans, and an ink deposition controller operatively coupled to the printmodes and the data buffer for activating the monochrome printmode when printing the monochrome region and the color printmode when printing the color region of the at least one individual data swath; and an analyzer operatively coupled to the data buffer and the ink deposition controller for receiving the data swaths, analyzing the data swaths to determine the state of a multiple-printmode-per-swath control flag, and communicating the control flag to the ink deposition controller.

19. The bidirectional swath printer of claim 18, wherein the multiple-printmode-per-swath control flag is enabled if a ratio of the monochrome region to the color region exceeds a threshold value and is disabled otherwise.

20. A method for printing a swath of data with a printhead arrangement of a swath printer, comprising:

processing the swath of data to identify a monochrome region and a color region;

verifying that a ratio of a size of the monochrome region to another size of the color region exceeds a threshold value;

moving the printhead arrangement relative to a color printing area of a medium a relatively greater number of times while printing the color region; and moving the printhead arrangement relative to a monochrome printing area of the medium a relatively fewer number of times while printing the monochrome region, so as to minimize printing time.

21. A method for printing a swath with a printhead arrangement, the swath having a swath height H and a swath width W, the swath printable by the printhead arrangement during a movement relative to a medium in a scan direction, comprising:

processing data associated with the swath to identify a monochrome region within the swath and a color region within the swath, each region having a region height H and a region width less than W;

moving the printhead arrangement in the scan direction a relatively greater number of times to print the color region; and moving the printhead arrangement in the scan direction a relatively fewer number of times to print the monochrome region.

22. A method for printing a swath with a printhead arrangement having different color inks, the swath having a swath height H and a swath width W, the swath printable by the printhead arrangement during a movement relative to a medium in a scan direction, comprising:

processing data associated with the swath to identify at least monochrome region within the swath and at least one color region within the swath, each region having a region height H and a region width less than W;

moving the printhead arrangement along a scan axis over at least one corresponding color printing area C times while depositing drops of the different color inks so as to print a corresponding one of the at least one color regions; and moving the printhead arrangement along the scan axis over at least one corresponding monochrome printing area M times, where M is less than C, while depositing drops of one of the different color inks so as to print a corresponding one of the at least one monochrome regions.

23. A bidirectional swath printer for printing swaths on a print medium, each swath having a swath height H and a swath width W, comprising:

a frame;

a carriage attached to the frame for relative motion with respect to the print medium in oscillating scans along a scan axis;

a printhead arrangement mounted to the carriage for controllably depositing drops of different color inks on the print medium during motion of the printhead arrangement; and a print controller operatively connected to the carriage and the printhead arrangement for moving the carriage and depositing the drops, the print controller including a data buffer for receiving data for the swaths, at least one individual swath having at least one color region and at least one monochrome region, each region having a region height H and a region width less than W, a monochrome printmode for depositing the drops for the monochrome region in a relatively fewer number of scans, a color printmode for depositing the drops for the color region in a relatively greater number of scans, and an ink deposition controller operatively coupled to the printmodes and the data buffer for activating the monochrome printmode when printing the monochrome region and the color printmode when printing the color region of the at least one individual data swath.

* * * * *